US007665550B2

(12) United States Patent
Rives

(10) Patent No.: US 7,665,550 B2
(45) Date of Patent: Feb. 23, 2010

(54) UNDERREAMER AND METHOD OF USE

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 0 days.

(21) Appl. No.: 11/718,315

(22) PCT Filed: Nov. 1, 2005

(86) PCT No.: PCT/US2005/039243

§ 371 (c)(1),
(2), (4) Date: Apr. 30, 2007

(87) PCT Pub. No.: WO2006/050252

PCT Pub. Date: May 11, 2006

(65) Prior Publication Data

US 2008/0115973 A1 May 22, 2008

Related U.S. Application Data

(60) Provisional application No. 60/522,722, filed on Nov. 1, 2004.

(51) Int. Cl.
*E21B 10/26* (2006.01)

(52) U.S. Cl. ..... 175/406; 175/297; 175/269; 175/286

(58) Field of Classification Search ..... 175/267, 175/269, 406, 286, 288, 325.4; 408/153, 408/161, 168, 169
See application file for complete search history.

(56) References Cited

U.S. PATENT DOCUMENTS

| | | | | |
|---|---|---|---|---|
| 342,218 | A * | 5/1886 | Miller | 408/164 |
| 2,490,397 | A * | 12/1949 | Aked | 408/168 |
| 2,846,904 | A * | 8/1958 | Dow | 408/161 |
| 3,871,488 | A | 3/1975 | Sabre | |
| 5,060,738 | A | 10/1991 | Pittard et al. | |
| 6,494,272 | B1 | 12/2002 | Eppink et al. | |
| 6,615,933 | B1 | 9/2003 | Eddison | |
| 6,732,817 | B2 | 5/2004 | Dewey et al. | |
| 7,048,078 | B2 | 5/2006 | Dewey et al. | |
| 7,314,099 | B2 | 1/2008 | Dewey et al. | |
| 2003/0079913 | A1 * | 5/2003 | Eppink et al. | 175/61 |
| 2005/0241856 | A1 | 11/2005 | Lassoie et al. | |
| 2005/0241858 | A1 | 11/2005 | Eppink et al. | |
| 2006/0144623 | A1 * | 7/2006 | Ollerensaw et al. | 175/269 |
| 2007/0163808 | A1 * | 7/2007 | Campbell et al. | 175/57 |

* cited by examiner

*Primary Examiner*—Jennifer H Gay
*Assistant Examiner*—Cathleen R Hutchins
(74) *Attorney, Agent, or Firm*—David B. Dickinson

(57) ABSTRACT

The present invention discloses a collapsible drilling assembly having field-replaceable cutter or stabilizer blades (214) and method of using and installing new stabilizer blades while at a job location. The drilling assembly is deployed upon a distal end of a drillstring, expanded to a gauge size, and used as an underreamer or alternatively a stabilizer. The drilling assembly operates between retracted and extended positions through the increase in pressure of drilling fluid flowing therethrough.

12 Claims, 11 Drawing Sheets

UNDERREAMER AND METHOD OF USE

CROSS-REFERENCE TO RELATED APPLICATION

This application claims priority to U.S. Provisional Application Ser. No. 60/522,722 filed Nov. 1, 2004, the entirety of which is incorporated herein by reference.

BACKGROUND OF THE INVENTION

The present invention relates generally to an underreamer to be used in a bottom hole assembly of a drillstring. More particularly, the present invention relates to a underreamer having retractable blades or pads configured to retract or engage a borehole along field-replaceable guide inserts or pins in a substantially linear path. More particularly still, the retraction or engagement of the blades or pads results from decreases or increases in working fluid pressure flowing through the retractable assembly.

Underreamers, in oilfield parlance, refer to downhole assemblies configured to enlarge existing boreholes. Underreamers function to enlarge smaller holes into larger-diameter boreholes. Often boreholes located below the lowest string of casing require bored diameters greater than the inner diameter of the next preceding string of casing. For these circumstances, an underreamer is installed behind a smaller drill bit and is run through the casing to the lower bore location. Once below the casing, the collapsible underreamer is expanded and a larger borehole is drilled. Once the larger bore is complete, the underreamer is retracted and the entire drilling assembly, bit, measurement equipment, and underreamer, is retrieved through the newly drilled borehole and casing thereabove.

Additionally, if the retractable cutters of an underreamer are substituted with retractable stabilizer pads, a retractable stabilizer can be effective in numerous subterranean drilling situations to centralize the drill string during operation. A retractable stabilizer can be employed, as above, to stabilize a retractable underreamer drilling assembly or, in the alternative, can serve as an adjustable gauge stabilizer. An adjustable gauge stabilizer is capable of reconfiguring its outer diameter to create an underreamed borehole of a desired size.

A recent exemplary expandable underreamer/stabilizer has been described in U.S. Pat. No. 6,732,817, issued on May 11, 2004 to Charles Dewey, et al., hereby incorporated by reference in its entirety. The invention disclosed in the Dewey patent relates to a three-bladed underreamer/stabilizer assembly wherein the three blades retract into and engage from a plurality of axial recesses having angled channels formed therein. The three blades of the Dewey patent engage the borehole by translating along the channels between a collapsed position and an expanded position in response to a differential pressure between an axial flowbore and the wellbore. The repetitive movement of the underreamer arms into and out of engagement in the presence of abrasive drilling fluids and cuttings can excessively wear the underreamer body thereby diminishing the useful life of the tool.

Unlike the prior art, the present invention reliably provides for direct movement of the blades into the expanded position resulting from the increase in pump pressure. Because the arms of the present invention are moved into engagement with the adjoining bore wall by direct movement of a piston or mandrel down the underreamer body, the circuitous hydraulic path of prior art tools, which can become clogged preventing free movement of the activator ring driving the arms into and out of engagement, is avoided. The present invention avoids this problem.

A hardfacing coating providing a low coefficient of friction of both the collapsible blades and the guides used to move these blades into and out of engagement with the bore wall additionally provides increased wear resistance and facilitates ready deployment under all well conditions. By utilizing a coating such as a QPQ nitride surface coating, the friction between the blades and guide inserts/pins is reduced. The hardfacing also makes the guide inserts/pins and blades more resistant the the abrasive drilling fluids present in a downhole environment. Because the guides and the blades can be replaced in the field when they become worn without the need to replace the entire underreamer body, the cost of using the underreamer with the present improvements is dramatically reduced over preexisting underreamer technology. The present invention constitutes a substantial improvement in the underreamer art by providing replaceable coated guides and blades.

SUMMARY OF THE INVENTION

The underreamer of the present invention provides a tubular body having an axial flowbore and at least one longitudinal pocket formed therein; a pair of removable guide inserts installed longitudinally within said longitudinal pocket, each guide insert having at least one linear projection; a collapsible blade installed within the longitudinal pocket between the pair of guide inserts and having a linear groove corresponding to each linear projection on the guide inserts whereby each linear groove engagably contacts the corresponding linear projection; and thereby permits the collapsible blade to translate or move in a substantially linear path along the linear projection between an extended position and a retracted position in response to a change in the pressure within the axial flowbore. The body can be fitted with between three to five blades without departing from the spirit of this invention. The underreamer of the present invention can have a mandrel longitudinally disposed within the tubular body and having a plurality of load fingers engagably contacting the collapsible blade to manipulate the collapsible blades between the retracted and the extended positions by longitudinal translation of the load fingers in response to changes in flowbore pressure on the mandrel. The underreamer normally further provides a biasing spring opposably contacting the mandrel to maintain the collapsible blade in the retracted position when there is no pressure within the flowbore.

The underreamer of the present invention provides the linear path of translation which is characterized by an acute angle departing from the central axis of the underreamer either upstream or downstream from said longitudinal pockets. The collapsible blade(s) and the guide inserts of the present invention can be QPQ nitride coated to provide wear resistance and to facilitate unrestricted movement of the blade out of and into the reamer body. These collapsible blade(s) can also include polycrystalline diamond cutter inserts, carbide buttons, or other hardened cutter elements, well known in the drilling industry. Furthermore, the blades can have cutting or hardened elements on a trailing face of each blade to allow the underreamer to operate coming out of the bore. The collapsible blade of the present invention can also be a stabilizer pad to allow this form of underreamer to be used as a stabilizer.

A method of enlarging a borehole is also disclosed herein comprising the steps of installing at a distal end of a drillstring a collapsible underreamer having a tubular body, and an axial flowbore with a mandrel installed therein, and at least one longitudinal channel with removable guide inserts, a collapsible blade, and a guide insert lock installed longitudinally therein; pressurizing the bore of the underreamer to engage the collapsible blade with a guide insert and substantially linearly translate the collapsible blade to an extended position; and rotating the drillstring with the collapsible blade in the extended position to enlarge the borehole. The method further comprises changing the pressure through the axial flowbore to retract the collapsible blades, and retrieving the collapsible underreamer through an under gauge string of casing.

Another method of using this underreamer comprises the steps of replacing the collapsible blade in the field by disconnecting the underreamer body from the drillstring; removing the mandrel; removing the guide insert lock; removing the used collapsible blade; inserting a replacement blade; reinstalling the guide insert lock; reinstalling the mandrel; and reinstalling the the underreamer body onto the drillstring.

This method can further provide for replacing the collapsible blade in the field by:

disconnecting the underreamer body from the drillstring; removing the mandrel; removing the guide insert lock; removing at least one guide insert; inserting a replacement replacement guide insert; reinstalling the guide insert lock; reinstalling the mandrel; and reinstalling the the underreamer body onto the drillstring. The method can further include replacing the collapsible blade in the field by disconnecting the underreamer body from the drillstring; removing the mandrel; removing the guide insert lock; removing the used collapsible blade; inserting a collapsible stabilizer pad in place of the blade; reinstalling the guide insert lock and the mandrel; and reinstalling the the underreamer body onto the drillstring.

Similarly, this method can further include shortening the radial extension of the collapsible blade by disconnecting the underreamer body from the drillstring; removing the mandrel; removing the guide insert lock; removing the used collapsible blade; inserting a collapsible stabilizer pad in place of the blade; reinstalling a longer guide insert lock than the removed guide insert lock; reinstalling the mandrel; and reinstalling the the underreamer body onto the drillstring.

The invention also includes a method to stabilize a drilling assembly in a borehole comprising the steps of installing above a drill bit at a distal end of a drillstring a collapsible stabilizer having a tubular body, an axial flowbore, and at least one longitudinal channel with removable guide inserts and a collapsible stabilizer pad installed longitudinally therein; pressurizing the axial flowbore of the collapsible stabilizer to engage the collapsible stabilizer pad with a guide insert and translate the collapsible stabilizer pad along a substantially linear projection of the guide insert to an extended position; and rotating the drillstring with the collapsible stabilizer pad in the extended position to stabilize the borehole.

Another embodiment of the present invention is underreamer to be used within a wellbore drilling assembly, the underreamer comprising a tubular body providing an axial flowbore and at least one longitudinal pocket, said longitudinal pocket having at least one hole cut through the tubular body on each longitudinal side of the longitudinal pocket; a removable pin inserted through the hole on each longitudinal side of the longitudinal pocket; a collapsible blade installed longitudinally within the longitudinal pocket and having a linear groove corresponding to each pin wherein each linear groove engagably contacts the corresponding pin to retain said collapsible blade within said tubular body; and the collapsible blade translates along the pin between an extended position and a retracted position in response to a change in the pressure within the axial flowbore.

A method of enlarging a borehole using this alternative embodiment comprises the steps of installing at a distal end of a drillstring a collapsible underreamer having a tubular body, an axial flowbore with a mandrel installed therein, and at least one longitudinal channel with removable pins securing a collapsible blade installed longitudinally therein; pressurizing the bore of the underreamer to engage a substantially linear groove formed in the collapsible blade with the removable pins and substantially linearly translate the collapsible blade to an extended position; and rotating the drillstring with the collapsible blade in the extended position to enlarge the borehole.

DETAILED DESCRIPTION OF THE PREFERRED EMBODIMENTS

Figure 1A:
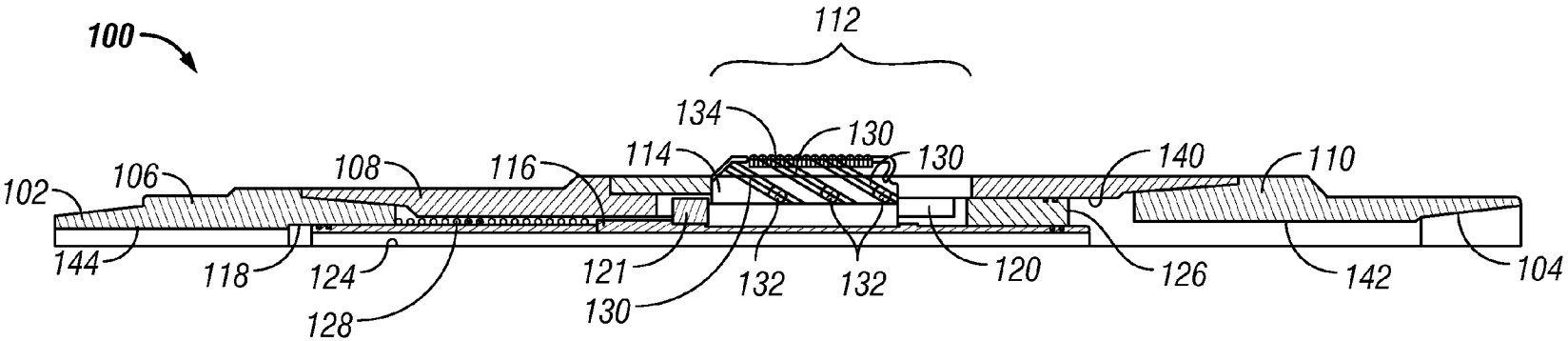
FIG. 1A is a schematic sectioned view drawing of a retractable downhole drilling assembly in an extended position in accordance with the present invention.
Figure 1B:
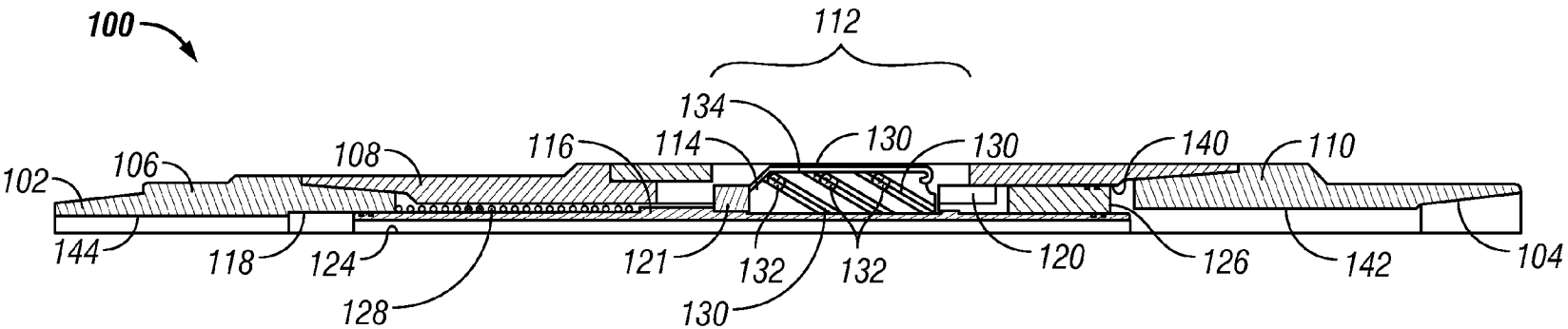
FIG. 1B is a schematic sectioned view drawing of the retractable downhole drilling assembly of FIG. 1A in a retracted position.

Referring initially to FIGS. 1A and 1B, a retractable underreamer 100 is shown. Specifically, FIG. 1A shows underreamer 100 in an extended position while FIG. 1B shows underreamer 100 in a retracted position. Underreamer 100 is shown with a pin-end connection 102 on its downhole, or distal, end and a box-end connection 104 on its uphole, or proximal, end. A pin-end connection refers to male threads and a box-end connection refers to female threads. While underreamer 100 is shown as an assembly of three threaded subs 106, 108, 110, it should be understood by one of ordinary skill in the art that multiple or single subs can be used to construct underreamer 100.

Underreamer 100 includes a plurality of longitudinal pockets 112 in which collapsible blades 114 are installed. Blades 114 are configured to extend (FIG. 1A) and retract (FIG. 1B) when a mandrel 116 is displaced. Mandrel 116 resides within a bore 118 of underreamer 100 and includes an engagement thruster 120 and a retraction thruster 121. The engagement thruster 120 is affixed to mandrel 116 by a locking ring (not shown) within a locking groove (not shown) on mandrel 116. The locking ring (not shown) is utilized to hold the engagement thruster 120 in place. This is shown in more detail in FIG. 4. Mandrel 116 also preferably includes a through bore 124 and a piston head 126. In FIG. 1A/B, a biasing spring 128 urges mandrel 116 in an upstream direction when no other loads are present upon mandrel 116. Collapsible blades 114 slide linearly in and out of pockets 112 along a plurality of linear grooves 130 molded into the sides of blades 114. Corresponding pins 132 are engaged into grooves 130 through main body 108 of underreamer 100 and are substantially perpendicular to pockets 112 and blades 114. The ratio of mandrel bore 124 to drilling assembly bore 118 is such that increases in pressure therethrough act upon piston head 126 with force great enough to oppose biasing spring 128 and displace mandrel 118 thus extending blades 114.

In operation, underreamer 100 is preferably deployed to a location of interest in a retracted state, extended, used downhole, re-retracted, and then retrieved. Such operations are often performed when a section of wellbore requires underreaming at a location below a section having a smaller bore diameter, for example, below a string of casing.

It should be understood by one ordinary skill that drilling assembly 100 can function either as an underreamer or as a stabilizer. An underreamer is designed to increase the diameter of a drilled wellbore while a stabilizer is used to contact a wellbore and stabilize the drillstring to prevent deviation of the drill bit.

To use underreamer 100 in a wellbore, the assembly is preferably deployed downhole behind a smaller drill bit in a collapsed state. To extend blades 114, the pressure of drilling fluid in the drillstring bore 124 is increased until the load upon piston head 126 is significant enough to displace mandrel 116 towards pin end 102. With the displacement of mandrel, engagement thruster 120 loads blades 114 from behind. Because blades 114 are held within pockets 112 by pins 132 in grooves 130, blades 114 slide outward and downhole (towards pin threaded end 102) from the loading of thruster 120. The linear arrangement of grooves 130 enable blades 114 to extend outward such that an outer face 134 of blades is always substantially parallel to an axis of drilling assembly 110. This parallel alignment helps ensure that blades engage the borehole in the best alignment possible, one that is substantially parallel to the path of the borehole to be stabilized or underreamed. With blades 114 extended drilling fluid is allowed to flow through bore 124 to lubricate a drill bit or operate any equipment farther downhole.

When the retraction of blades 114 is desired, the pressure of drilling fluids through bore of drillstring 118 can be reduced to allow biasing spring 128 to move mandrel 116 away from pin end 102. With mandrel 116 retracting, retraction thruster 121 can drive blades 114 upstream and towards box end 104. Because pins 132 can engage grooves 130, blades 114 can retract within pockets 112, maintaining their substantially parallel alignment to the axis of main sub 108.

A simple "quick change" configuration is possible, whereby mandrel 116 is moved out of engagement with spring 128, and alternate blades 114 are installed. This permits installation of replacement blades in the underreamer at a job site and avoids the need to send the entire underreamer body back to a shop for blade replacement.

Several benefits of underreamer 100 over former retractable underreamers include the simplicity of operation, manufacture, maintenance, and repair. Main body 108 of drilling assembly 100 is constructed of a simple tubular design with a series of bores and simple cuts. Only a simple groove to retain the guide insert or several holes to insert pins is required within pockets 112. No complex grooves or machined surfaces are required in pockets 112 or in bore 118. Because only a small number of simple grooves to retain guide inserts 700, 750 are required within the body of the underreamer rather than multiple complex machined profiles within the walls of pockets 112, manufacture, maintenance, and repair of drilling assembly 100 is relatively simple and quick. Alternatively, the blades 700, 750 can be retained by drilling standard holes into the longitudinal pockets 112 to insert pins 132. Furthermore, the method for engaging or disengaging blades 114 is relatively simple compared to other solutions. Particularly, piston head 126 travels within a piston bore 140 that is somewhat larger than the ordinary flow bore 142 through the drillstring components thereabove. Furthermore, the diameter of bore 124 through mandrel 116 is substantially similar to the diameters of flow bores 142 before and 144 after mandrel 116, resulting in negligible pressure drop across drilling assembly 100. Because of the high cross-sectional area of the piston face between piston bore 140 and flow bore 124 through mandrel 116, much higher loads can be transferred from the pressurized drilling fluid to blades 114. As a result, drilling assembly 100 is capable of operating retractable blades 114 with much lower pressure drop than former devices. Lower pressure drop across drilling assembly 100 requires lower "activation" pressures to extend (or retract) blades 114. The lowered pressures are beneficial in that that hydraulic seals and components of other drillstring devices are not susceptible to rupture.

Figure 2:
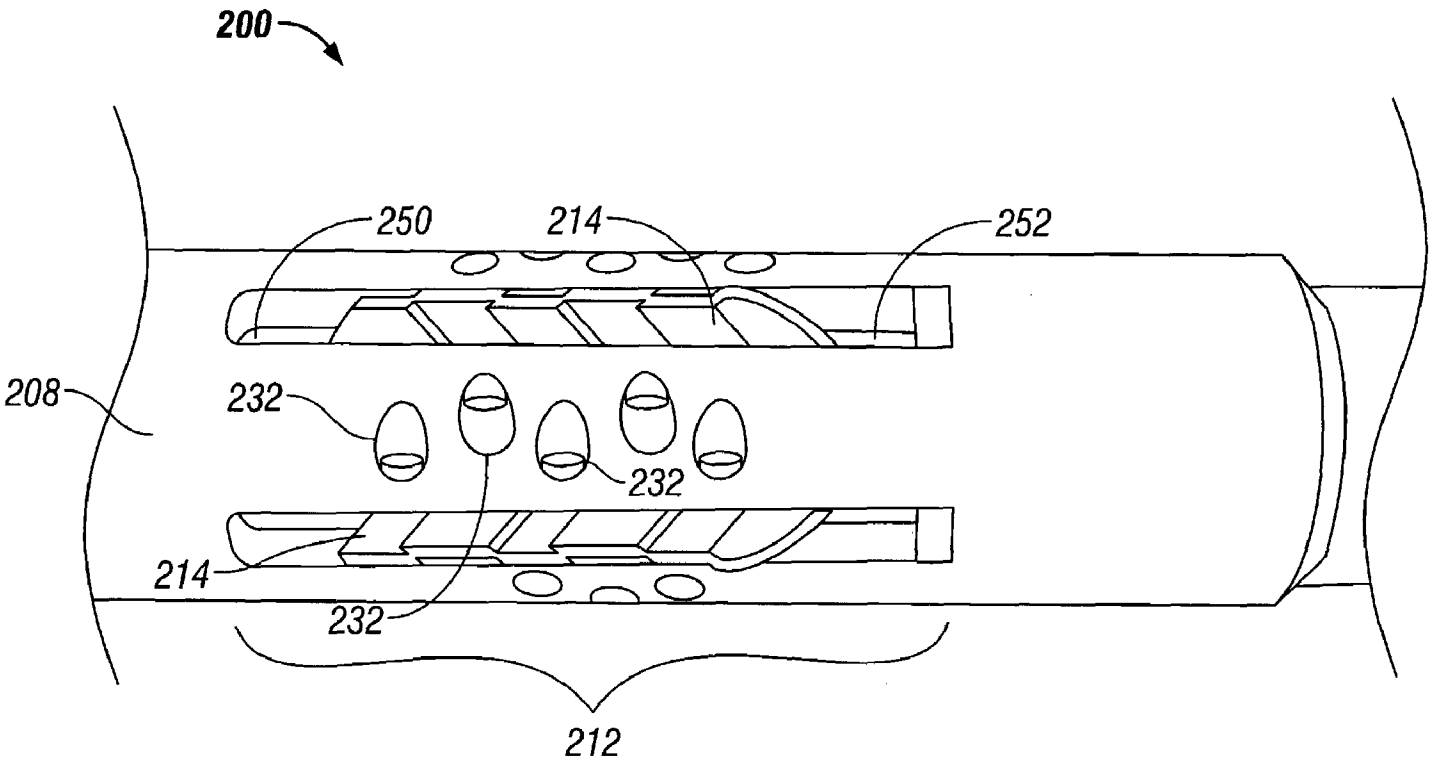
FIG. 2 is a schematic representation of a section of a retractable downhole drilling assembly in a retracted position in accordance with a preferred embodiment of the present invention.

Referring generally to FIGS. 2-5, a drilling assembly 200 in accordance with one embodiment of the present invention is shown. Referring first to FIG. 2, a drilling assembly 200 is shown having a main sub 208, and a plurality of collapsible blades 214 shown in a retracted state. Main sub 208 includes a plurality of longitudinal grooves 212 in which blades 214 are positioned and from which they extend. A plurality of pins 232 on opposite sides of each groove 212 retains each blade 214 in place.

Figure 3:
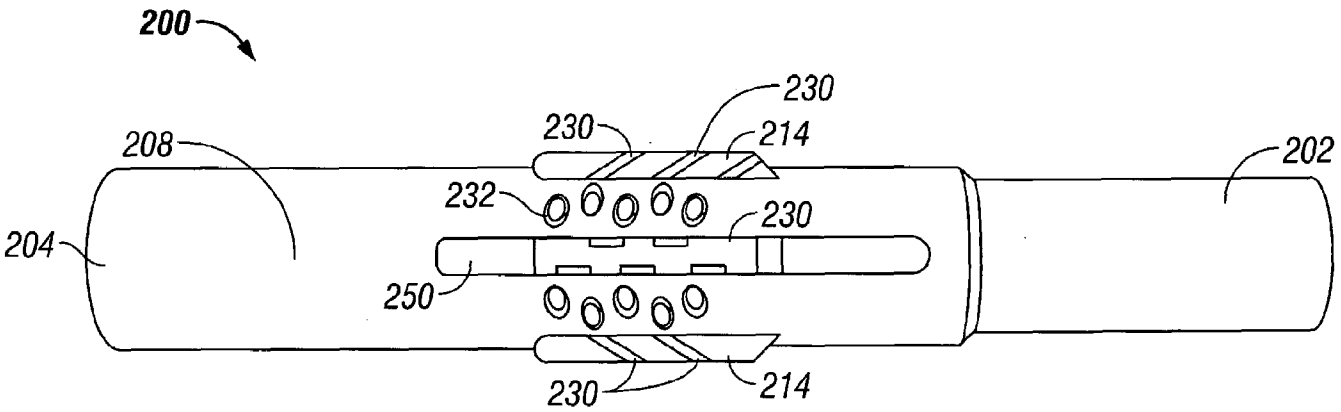
FIG. 3 is a schematic representation of the retractable downhole drilling assembly of FIG. 2 in an extended position.
Figure 4:
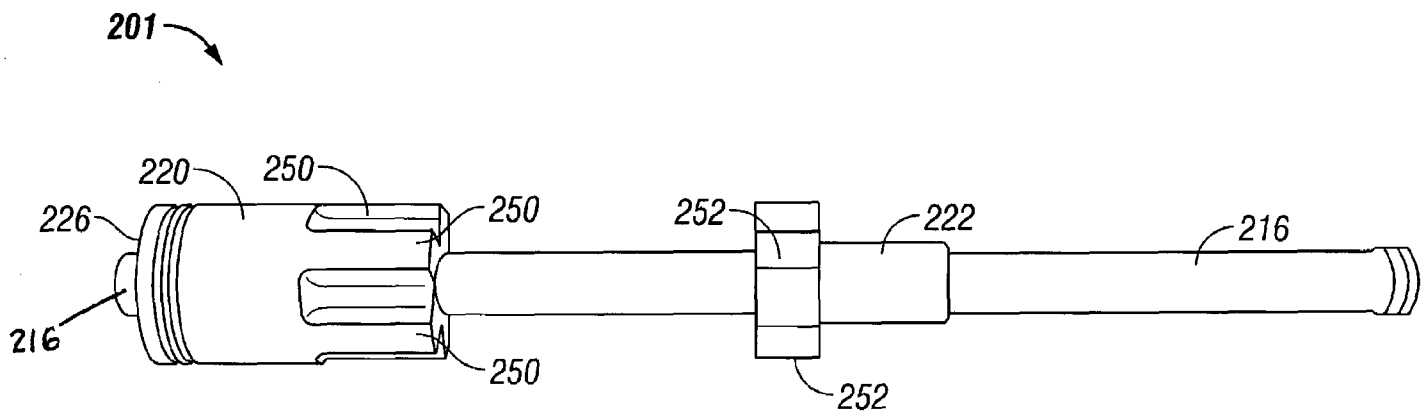
FIG. 4 is a schematic representation of a mandrel used to operate the retractable downhole drilling assembly of FIGS. 2 and 6A/B.

As depicted in FIGS. 2-4, drilling assembly 200 is constructed with 5 extendable blades 214. It should be understood by one of ordinary skill in the art that any number of blades can be employed with the present invention, but 5 blades 214 are preferred. Typical underreamers only utilize 3 or fewer blades. This typical limitation is primarily a result of geometric limitations of the tools themselves. Because of the compactness of the drilling assembly and blade configuration of the present invention, additional blades are possible. For circumstances where drilling assembly 200 is to be used as an underreamer, additional blades translates to additional cutting surfaces, enabling the operator to enjoy longer cutter lifespan, or faster cutting rates. In circumstances where drilling assembly 200 is to be used as a stabilizer, it may be optimal to only employ 3 blades 214 in an effort to minimize any flow restrictions in the annulus between the drillstring and the wellbore. However, the use of 5 blades in place of 3 on a stabilizer makes for a more precisely centered drillstring, if desired.

Referring now to FIG. 3, the drilling assembly 200 is shown with blades 214 in an extended position. Blades 214 have linear grooves 230 on either side for receipt of pins 232. Drilling assembly 200 is preferably constructed such that blades 214 follow a substantially linear path from retraction to extension that maintains blades 214 substantially parallel to main sub 208 throughout the entire range of the extension motion. Furthermore, it is preferred that the path of extension for blades 214 be characterized by an acute angle with respect to the axis of the main sub 208. Drilling assembly 200 is constructed such that the direction of that acute angle is towards the downhole end 202 of sub 208, but uphole extension may be accommodated, if desired. Furthermore, if so desired, the present invention could be slightly modified to allow for a radial extension of blades 214 along a path substantially orthogonal to the axis of main sub 208. No specific angle is required for the invention to function, and various angles can be utilized as desired. As can be seen from FIG. 3, each blade 214 of drilling assembly 200 is retained in place by 5 pins 232, 3 on one side, and 2 on the other side. While this configuration is exemplary, it should be understood that various other configurations and quantities of pins 232 are possible and within the scope of the present invention.

Referring now to FIG. 4, a mandrel assembly 201 to be used with drilling assembly 200 is shown. Mandrel assembly 201 includes a mandrel 216, an engagement thruster 220 and a retraction thruster 222. Engagement thruster 220 includes a piston head 226 upon which elevated pressure from drilling fluids acts to displace mandrel assembly 201 within drilling assembly 200, extending (or retracting) blades 214. The engagement thruster 220 is detachable from the mandrel 216. The mandrel 216 includes a locking ring groove (not shown) on the end adjacent the engagement thruster 220. A locking ring (not shown) can be installed in locking ring groove (not shown) on mandrel 216 to hold engagement thruster 220 in place. Additionally, load fingers ring 252 is moved on retraction thruster surface 222 on mandrel 216. The load fingers ring 252 held in place by retraction thruster surface 222 on the mandrel 216 tapering on one end and the retractable blade 214 (not shown in FIG. 4) on the other.

Typically, the installation procedure consists of installing the blades 214 within the longitudinal pockets 112. The blades 214 are retained in the extended position by clamps or other means after which the installation of the mandrel assembly 201 is accomplished. The mandrel assembly 201 is assembled by inserting the mandrel 216, formed with retraction thruster surface 222, into the bore 140 of the drilling assembly 200 or 600. The blade 214 and guide inserts 700, 750 are released from their retained extended position or pins 232 (on the other embodiment) can then be installed. Then the engagement thruster 220 and locking ring (not shown) are installed. Once this is complete, the drilling assembly 100, 200, 600 is assembled and ready for use.

Additionally, engagement thruster 220, includes a plurality of load fingers 250 that correspond to each blade 214 of drilling assembly 200, 600. Engagement thruster ring 252 carried on engagement thruster surface 222 also has load fingers corresponding to each blade 214 of drilling assembly 200, 600. Load fingers 250, 252 engage longitudinal pockets (as indicated in FIGS. 2-3) and thrust blades 214 into (250) and out of (252) the engaged position. The load finger 250 pushes the blade 214 upward and out as the mandrel 216 responds to changes in fluid pressure. As the mandrel 216 responds in the opposite direct, load fingers 252 retract the collapsible blades 214.

Figure 5:
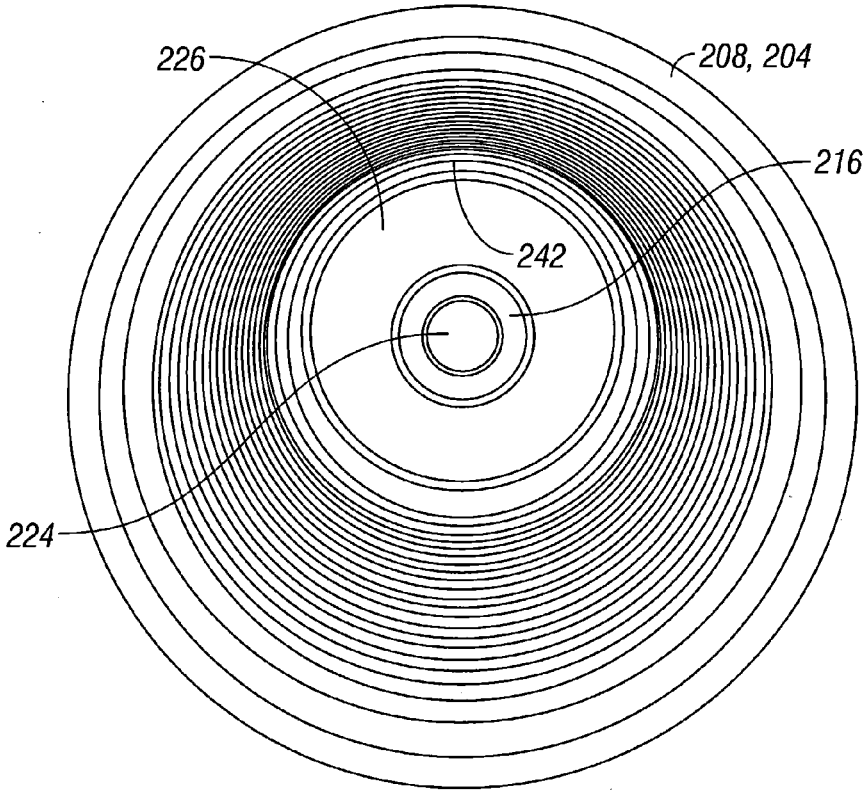
FIG. 5 is a schematic representation of a piston and through bore of the mandrel of FIG. 4.

Referring briefly to FIG. 5, uphole end 204 of main sub 208 is shown. Mandrel 216 with piston head 226 is visible from this end and the ratio between bores 242 and 224 is visible. When pressures within the bore of the drillstring are elevated, hydraulic pressure exerts force upon piston head 226 as a result of the difference in diameter between bores 242 and 224. By making ratio of bores 242 and 224 larger, more force upon mandrel 216 will result for incremental increases in bore pressure.

Figure 6A:
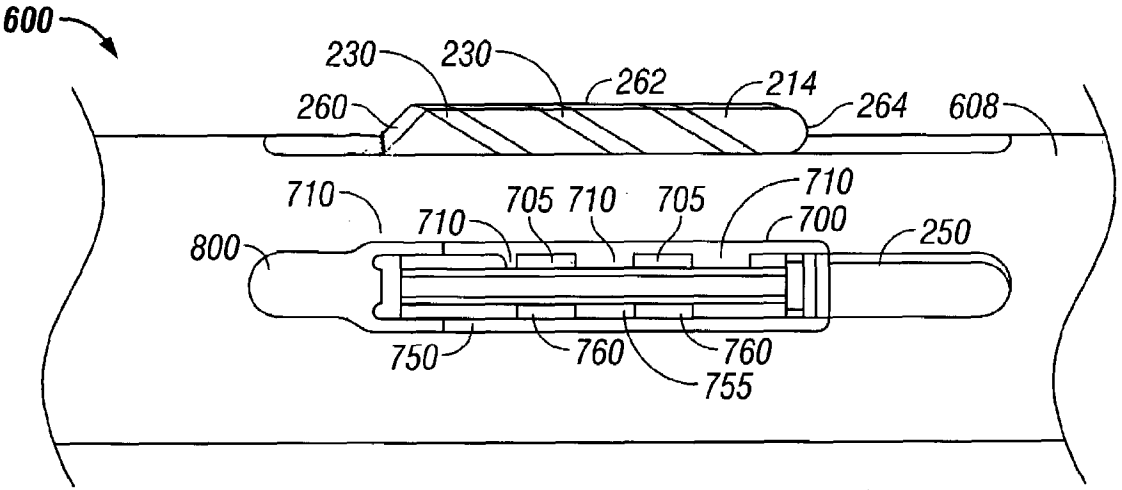
FIG. 6A is a schematic representation of a retractable downhole drilling assembly with removable inserts for installing the collapsible blades.
Figure 6B:
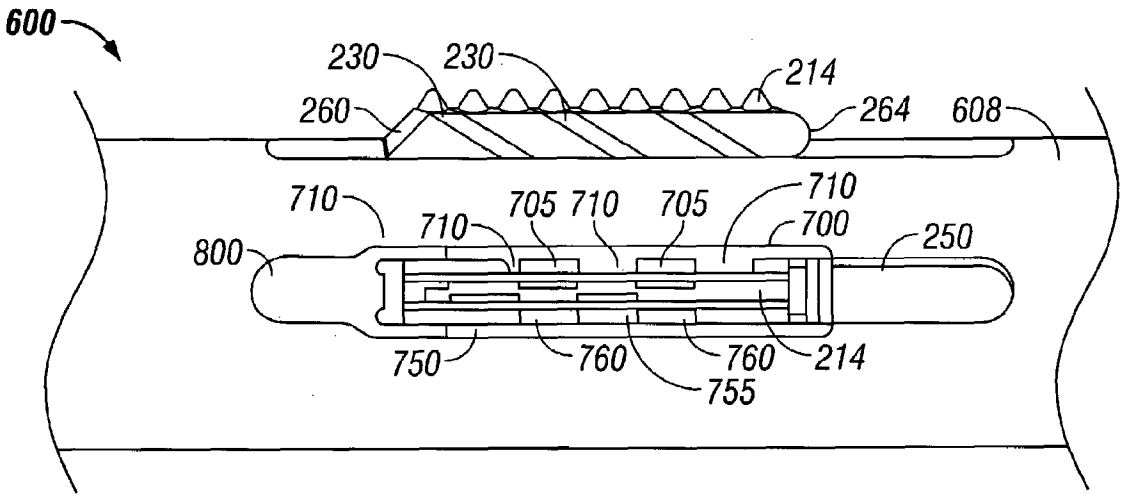
FIG. 6B is a schematic representation of the retractable downhole drilling assembly of FIG. 6A with cutting surfaces on the collapsible blades.

Referring now to FIGS. 6A/B, an alternate embodiment of the drilling assembly 200 is shown. Drilling assembly 600 has a main sub 608 with a plurality of longitudinal pockets 612. Unlike the other embodiments, there are no holes in the main body 208 for pins. Instead, the collapsible blades 214 fit between a left guide insert 700 and a right guide insert 750. The guide inserts 700, 750 have grooves that match the grooves on the corresponding collapsible blade 214. The guide inserts 700, 750 and collapsible blade 214 are shown in more detail in FIGS. 7A-C. The collapsible blades 214 of FIG. 6 are substantially identical to the collapsible blades 214 of FIG. 2. The same collapsible blades 214 can be used with both a pin configuration as shown in drilling assembly 200 and a guide insert configuration as shown in drilling assembly 600.

The guide inserts 700, 750 have an outer surface 715, 765 that protrudes from the main insert body to engage with the sides of the longitudinal pockets 612 of main sub 608. The inner surface of the guide inserts guide inserts 700, 750 have a plurality of raised surfaces 710, 760 to create a plurality of raised surfaces 710, 760 and grooves 705, 755. The raised surfaces 710, 760 and grooves 705, 755 for each pair of guide inserts 700, 750 must match the configuration of linear grooves 230 for each collapsible blade 214.

Figure 7A:
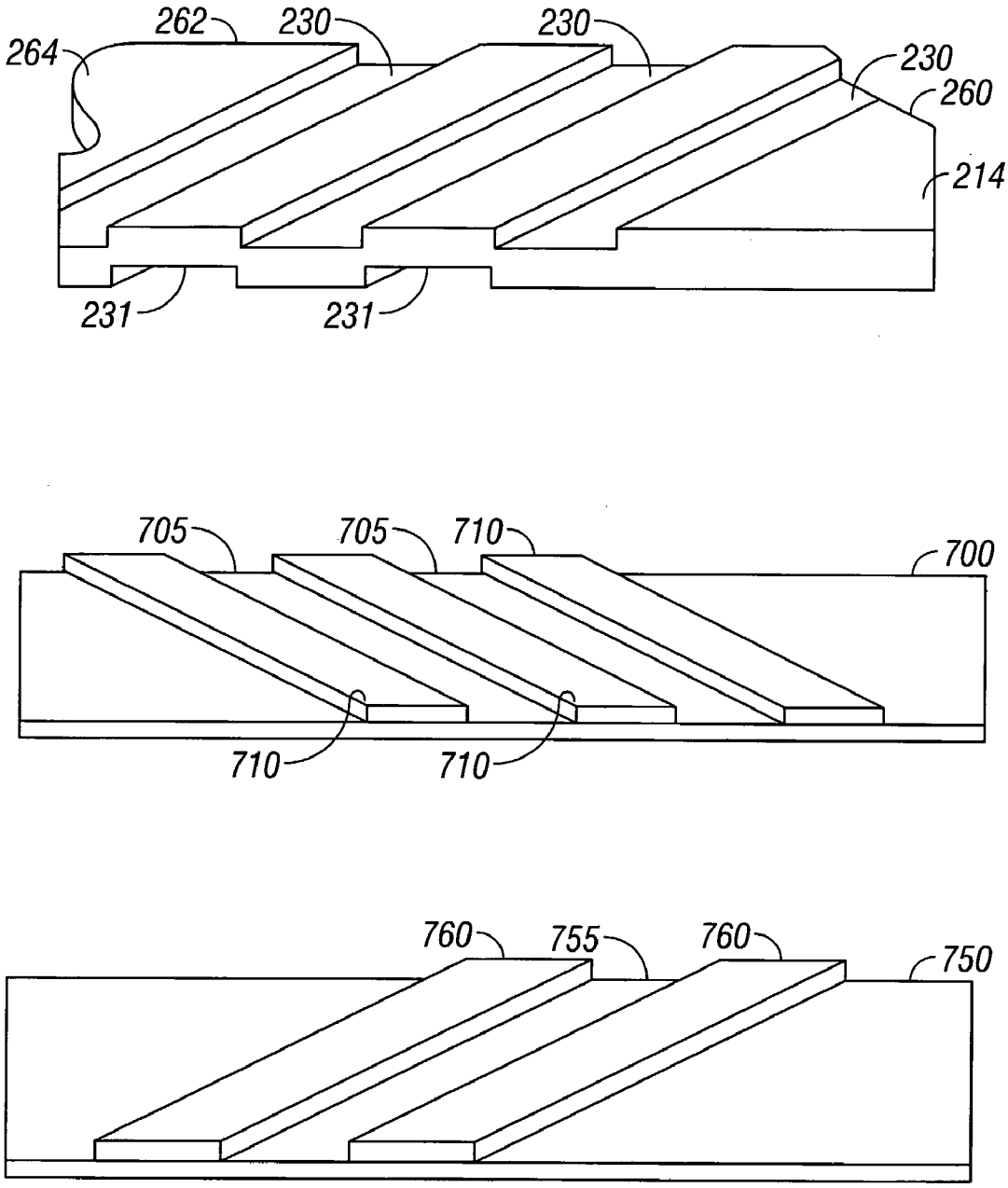
FIGS. 7A-C depicts multiple representations of the guide inserts and collapsible blade to be used with the retractable downhole drilling assembly of FIGS. 6A/B.
Figure 7B:
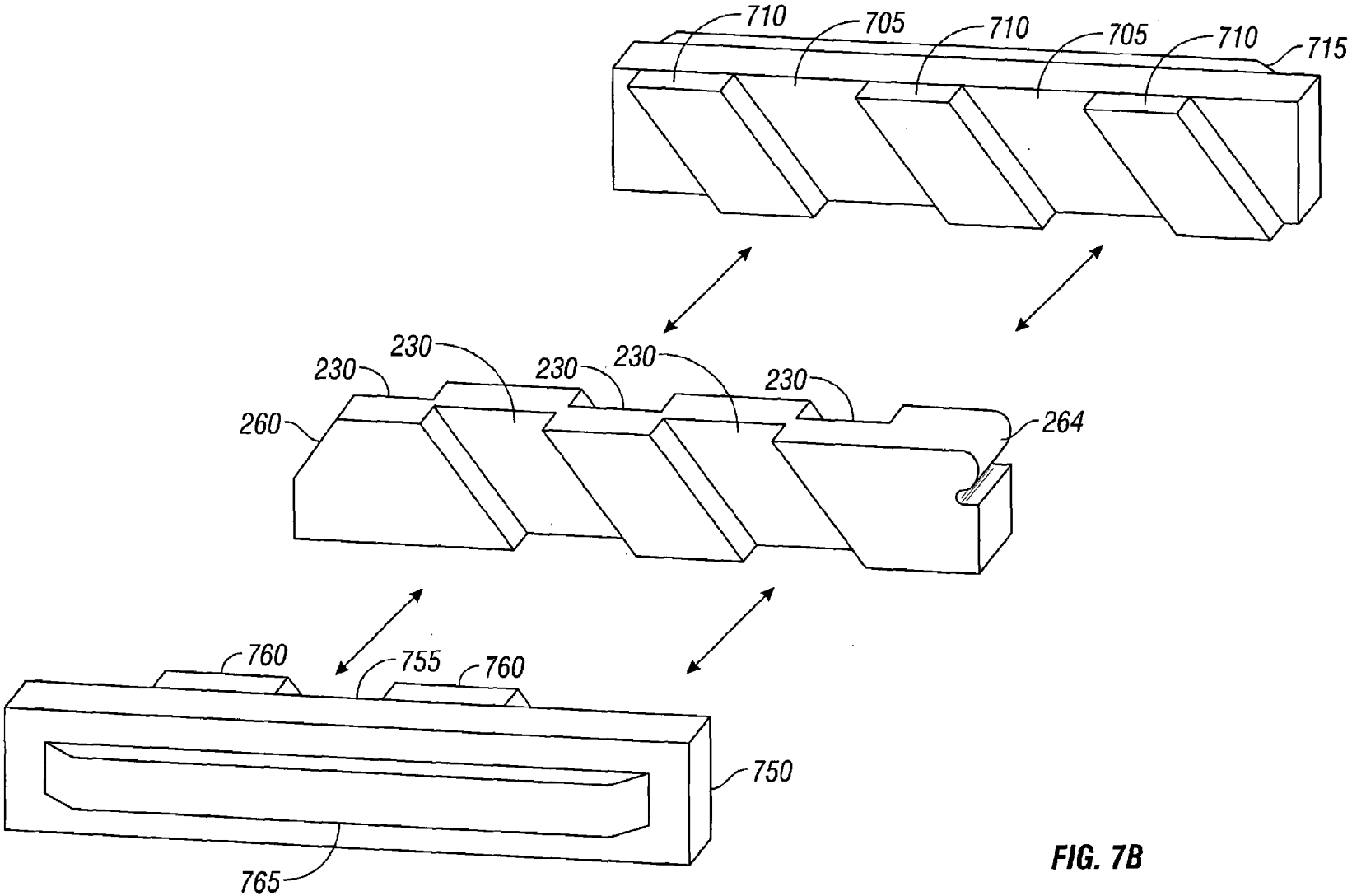
Figure 7C:
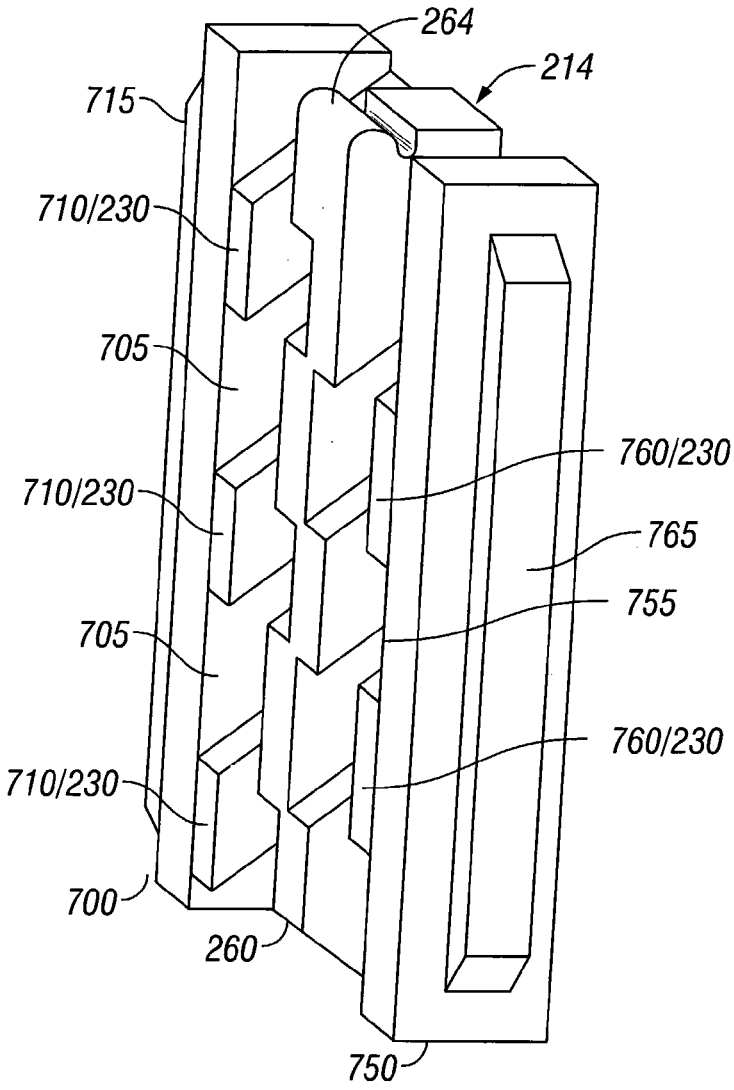
Figure 7C:
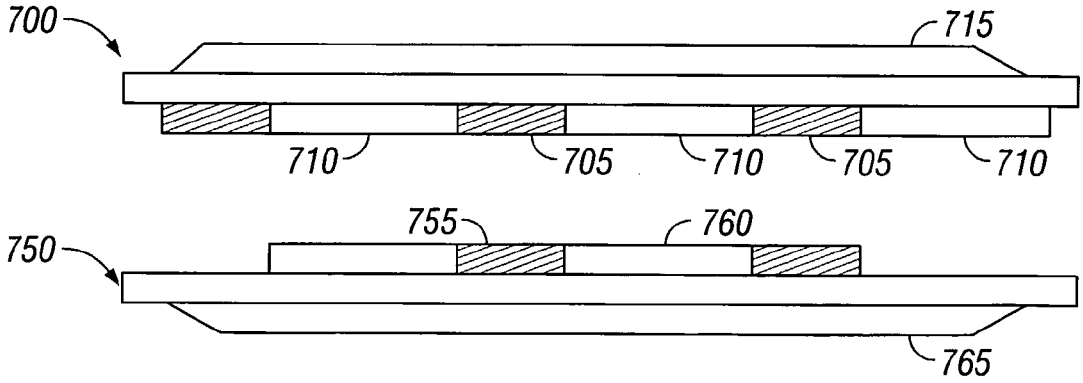
Figure 8:
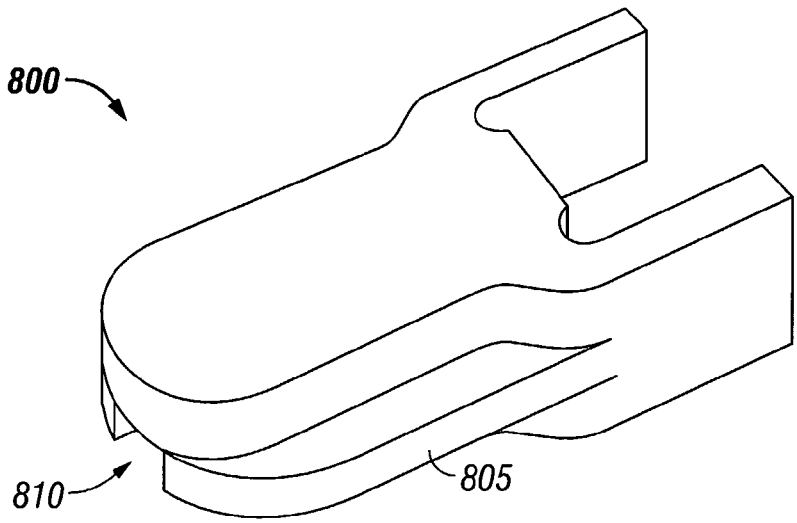
FIG. 8 depicts a perspective view of one embodiment of the guide insert lock used to hold the guide inserts and blades within the tool body shown in FIGS. 6A/B.
Figure 9A:
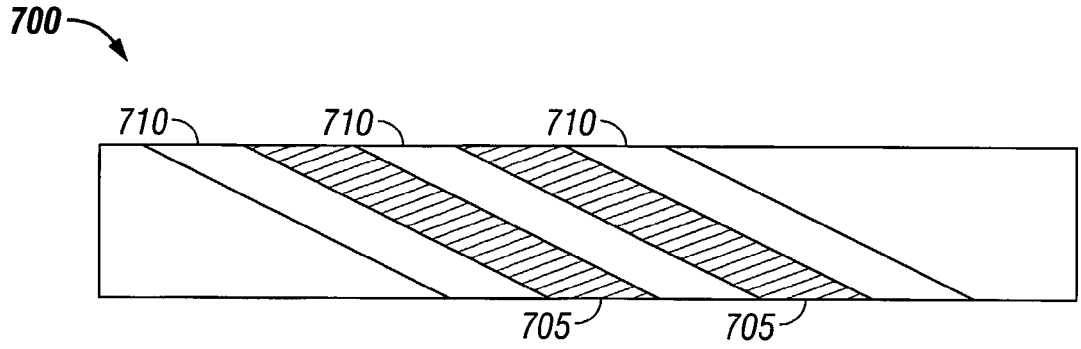
FIGS. 9A-B depict a top and side view of one embodiment of a guide insert for guiding the motion of the retractable blade within the tool body shown in FIGS. 6A/B.
Figure 9B:
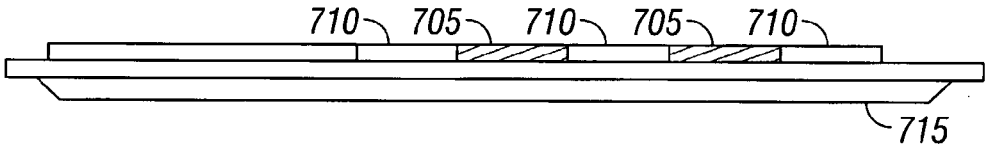
Figure 10A:
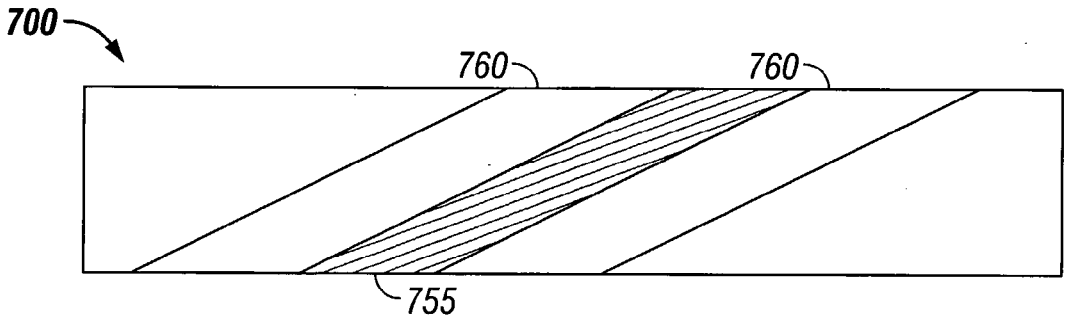
FIGS. 10A-B depicts a top and side view of one embodiment of a matching guide insert for the guide insert shown in FIGS. 9A/B.
Figure 10B:
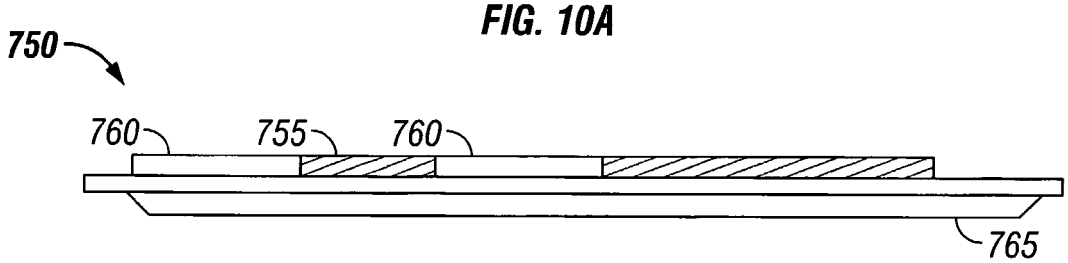
Figure 11A:
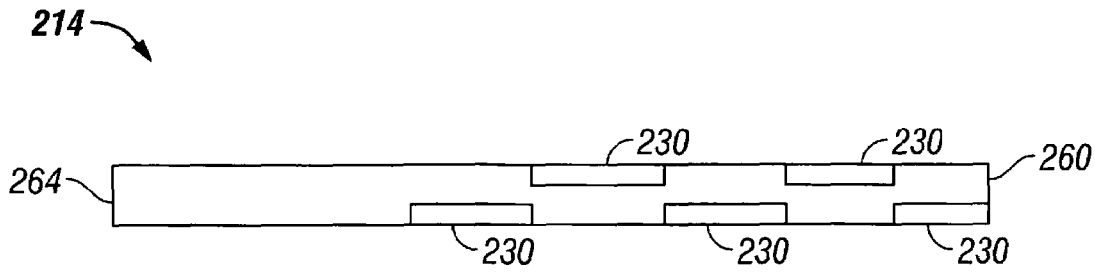
FIGS. 11A-C depict a top view and a view from each side of the retractable blade that fits between the guide insert of FIGS. 9A/B and 10A/B.
Figure 11B:
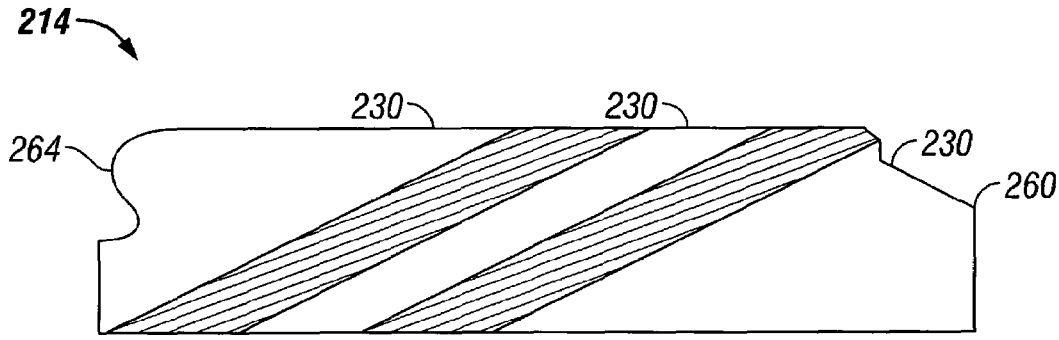
Figure 11C:
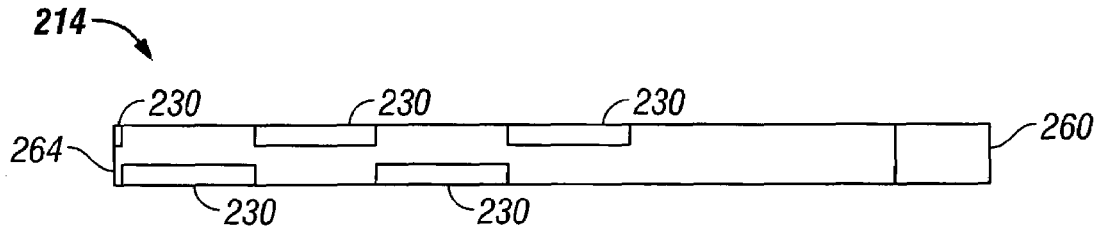

Referring now to FIGS. 7A-C, blade 214 for drilling assembly 200, 600 is shown. Blade 214 includes linear grooves 230 for engagement with pins 232 or guide inserts 700, 750 of drilling assembly 200, 600 respectively. Blades 214 are preferably constructed from machined tool steel and are configured with a leading surface 260, a primary wear surface 262, and a trailing surface 264. Leading 260 and primary 262 wear surfaces are expected to carry the brunt of the wear of blades 214 during any underreaming or stabilizing operation. Trailing surface 264 is constructed to be used to drill out of a situation where the borehole collapses in behind drilling assembly 200. Referring now to FIGS. 7B/C, the outside surface of each guide insert has a retaining projection 715, 765. The retaining projection 715, 765 is designed to match a corresponding retaining groove (not shown) cut into longitudinal pockets 112. The retaining projection 715, 765 fits into a mating groove on each side of the longitudinal pocket 112 to maintain the position of the guide inserts. Additionally, the retaining surface 805 on guide insert lock 800 also fits into the retaining groove (not shown). Once the retaining projection 715, 765 on guide inserts 700, 750 and the retaining surface 805 are locked into the corresponding groove (not shown) on the longitudinal passage 112, the mandrel 216 can be installed and the load fingers 250, 252 engaged. The final assembly of this is demonstrated in FIGS. 6A and 6B.

Additionally, the guide insert lock 800 acts as a stop to prevent additional movement of the collapsible blades 214. As the mandrel load fingers 250 force the collapsible blade 214 towards the guide insert lock 800 causing the collapsible blades to translate linearly along the raised sections 710, 760 of guide inserts 700, 750. Once the leading edge 260 of the collapsible blade 214 reaches the guide insert lock 800, the motion of the collapsible blade 214 is halted. No additional radial extension is possible without damaging the underreamer. By varying the length of the guide insert lock 800, the radial extension of the collapsible blade 214 can be limited. This same process can be utilized to limit the radial extension when a stabilizer pad is utilized instead of the collapsible blade 214. Additionally, guide insert lock 800 distributes excessive forces to the entire body of the underreamer rather than concentrating wear on the interior shoulder of the underreamer found in other prior art devices.

For use with a drilling assembly such as shown by elements 100 and 200 if FIGS. 1A/B and 2, guide inserts 700, 750 are not required. However, for a typically more durable construction, guide inserts 700, 750 can be used. The collapsible blade 214 fits between the guide inserts 700, 750 by aligning the raised sections 710 of guide insert 700 with the grooves 230 in collapsible blade 700; similarly, the raised sections 760 of guide insert 750 are aligned with the grooves 231 in collapsible blade 214. FIGS. 7A-C show various examples of how the guide inserts 700, 750 and the blade 214 interact. Once the guide inserts 700, 750 are assembled properly, they are placed within the channel 612 and held into place by guide insert lock 800. This process will be described in more detail with regards to maintenance of drilling assembly 600.

Referring back to FIGS. 6A/B, drilling assembly 600 functions in a manner similar to drilling assembly 200 in operation. The principal difference is when the mandrel 118 thrusts against the collapsible blade 214, the blade 214 is forced outward in a linear path along the grooves of the guide inserts 700, 750. This configuration is stronger than the pin configuration because there is a larger surface area in contact with the collapsible blade 214, i.e. the grooves 230 in the blade 214 are generally in contact with the surface area of the raised sections 710, 755 of the guide inserts. This allows the drilling assembly 600 to last longer or accept more torque than drilling assembly 100 or 200. While drilling assembly 600 is stronger than drilling assemblies 100 and 200, drilling assemblies 100, 200, and 600 are all advantageous in their ease of maintenance and manufacture.

Maintenance of the drilling assembly 600 is also simplified over the prior art. The guide inserts 700, 750 and the collapsible blades 214 can be replaced in the field as they wear out. The process or replacing these components consists of removing any force causing the mandrel 118 to exert force on the guide inserts 700, 750 or the blades 214. Once the force is released, the guide insert lock 800 can be removed from the recessed channel 612. Once the guide insert lock 800 is removed, the guide inserts 700, 750 and blade 214 can be easily removed from the recessed channel 612. This process can be repeated for each set of blade/guide inserts combination. The maintenance procedure for drilling assembly 200 is similar but requires removal of the pins 232 instead of the guide inserts 700, 750.

To replace any of these "wear" components, the operator can obtain replacement components as necessary and assemble a set consisting of a blade 214 and its corresponding guide inserts 700, 750 as shown in FIG. 7C. Once the set is assembled, the set can be placed into a recessed channel 612 while the mandrel 118 force is released. The guide insert lock 800 is then slid into place and the mandrel force reapplied to hold the guide inserts 700, 750, collapsible blade 214 and guide insert lock 800 in place.

This ability to field-dress the drilling assembly 100, 200, 600 is advantageous because the main assembly 108, 208, 608 of the present invention will infrequently need service. The only parts that will be routinely replaced are the "wear" components such as the pins 232, guide inserts 700, 750, guide insert lock 800, and the collapsible blades 214. These components are much smaller to ship and much easier for an operator to maintain in inventory. Additionally, it makes it possible for an operator to keep multiple types of blades to be utilized for different formations or drilling situations. Some blades may contain carbide cutters, while others may use PDC cutting elements or other types of cutters/stabilizers. An operator can also easily change between a cutter blade and a stabilizer blade. This allows extreme flexibility to the operator in the field. An entire set of underreamer/stabilizer tools can be maintained in the field at a minimum of cost and space.

Depending on the configuration of drilling assemblies 200, 600 different materials and configurations for surfaces 260, 262, and 264 are possible. For underreamers, hardened cutting elements (not shown) are preferably placed on the periphery of surfaces 260, 262, and 264. For stabilizer purposes, hardened wear-resistant materials are preferred. The specific installations for materials and cutter elements upon surfaces 260, 262, and 264 are well known to those skilled in the art, but specific materials and elements that are expected to be used include, but are not limited, to, polycrystalline diamond cutters (PDC), hardened metal cutter elements, carbide buttons, carbide inserts, hard metal overlays, flame-sprayed hard metal coatings, plasma-sprayed hardened coatings.

Additionally, certain coatings such as QPQ nitride coating of both the guide inserts 700,750 and the blades 214 can be advantageous. While QPQ nitride coating of parts to increase durability is well known by one of ordinary skill in the art, QPQ nitride coating provides unexpected results in the present invention. By coating both the pins 232 or guide inserts 700, 750 with a QPQ nitride coating along with the cutter/stabilizer blades 214, the friction between the two parts when expanding and retracting is thereby significantly reduced. This friction reduction can be advantageous and result in a longer useful life of both the guide inserts 700, 750 or pins 232 and the stabilizer/cutter blades 214. While it is well known to coat the actual parts performing cutting operations such as the blades 214, the coating of both the blades 214 and the guide inserts 700, 750 or pins 232 provides an increased service life of the components, thus making the drilling assembly 200, 600 have decreased maintenance costs and decreased downtime.

What is claimed is:

1. An underreamer to be used within a wellbore drilling assembly, the underreamer comprising:

a tubular body providing an axial flowbore and a plurality of longitudinal pockets;

a pair of removable guide inserts installed longitudinally within each of said longitudinal pockets, each guide insert having at least one linear projection;

a collapsible blade installed within each of the longitudinal pockets between the pair of removable guide inserts and having linear grooves in opposing sides thereof corresponding to each linear projection on the pair of guide inserts whereby each linear groove engageably contacts a corresponding linear projection; and the collapsible blade translates in a substantially linear path between an extended position and a retracted position in response to a change in pressure within the axial flowbore.

2. The underreamer of claim 1 having a mandrel longitudinally disposed within the tubular body and having a plurality of load fingers engageably contacting the collapsible blades to manipulate the collapsible blades between the retracted and the extended positions by longitudinal translation of the load fingers in response to the change in flowbore pressure on the mandrel.

3. The underreamer of claim 2 further comprising a biasing spring opposeably contacting the mandrel to maintain the collapsible blade in the retracted position when there is no pressure within the flowbore.

4. The underreamer of claim 1 wherein the linear path of translation is characterized by an acute angle departing from the central axis of the underreamer upstream from said longitudinal pockets.

5. The underreamer of claim 1 wherein the linear path of translation is characterized by an acute angle departing from the central axis of the underreamer downstream from said longitudinal pockets.

6. The underreamer of claim 1 wherein each pair of removable guide inserts are hardened.

7. The underreamer of claim 1 wherein each collapsible blade is a stabilizer pad.

8. The underreamer of claim 1 wherein each collapsible blade has a trailing edge including a cutting surface thereon.

9. A method of enlarging a borehole comprising:

installing at a distal end of a drillstring a collapsible underreamer having a tubular body, an axial flowbore with a mandrel installed therein, and a plurality of longitudinal channels with a pair of removable guide inserts, a collapsible blade, and a guide insert lock installed longitudinally therein;

pressurizing the axial flowbore of the underreamer to engage opposing sides of the collapsible blade with the pair of removable guide inserts and substantially linearly translate each collapsible blade to an extended position; and rotating the drillstring with each collapsible blade in the extended position to enlarge the borehole.

10. The method of claim 9 comprising changing a pressure within the axial flowbore to retract each collapsible blade, and retrieving the collapsible underreamer through an under gauge string of casing.

11. The method of claim 9 further including replacing the collapsible blade in the field by:

disconnecting the collapsible underreamer from the drillstring;

removing the mandrel;

removing each collapsible blade;

inserting replacement collapsible blades reinstalling the mandrel; and reinstalling the collapsible underreamer onto the drillstring.

12. The method of claim 9 further including shortening a radial extension of the collapsible blade by disconnecting the collapsible underreamer from the drillstring;

removing the mandrel;

removing guide inserts;

removing the guide insert lock;

reinstalling a longer guide insert lock longer than the removed guide insert lock;

reinstalling the guide inserts;

reinstalling the mandrel; and reinstalling the collapsible underreamer body onto the drillstring.

* * * * *